US006581991B2

(12) United States Patent
Galindo

(10) Patent No.: US 6,581,991 B2
(45) Date of Patent: Jun. 24, 2003

(54) AUTOMATED DOOR LATCH ACTUATOR ESPECIALLY ADAPTED FOR MORTISE LOCKS AND METHOD CORRESPONDING THERETO

(75) Inventor: Jaime Galindo, Reno, NV (US)

(73) Assignee: Securitron Magnalock Corporation, Sparks, NV (US)

( * ) Notice: Subject to any disclaimer, the term of this patent is extended or adjusted under 35 U.S.C. 154(b) by 0 days.

(21) Appl. No.: 09/851,254

(22) Filed: May 7, 2001

(65) Prior Publication Data

US 2002/0163210 A1 Nov. 7, 2002

(51) Int. Cl.[7] ..... E05B 15/02; E05B 1/06

(52) U.S. Cl. ..... 292/341.16; 292/341.18; 292/144

(58) Field of Search ..... 292/341.16, 341.15, 292/341.18, 341.19, 341.14, 340, 144, DIG. 39, DIG. 40; 70/107, 110, 278.7

(56) References Cited

U.S. PATENT DOCUMENTS 4,453,752 A * 6/1984 McKann ..... 292/341
4,867,496 A * 9/1989 Thomas ..... 292/252
4,984,835 A * 1/1991 Vadacchino et al. ..... 292/144
5,076,625 A * 12/1991 Oxley ..... 292/201
5,474,342 A 12/1995 Smith et al.
6,022,056 A 2/2000 Cope et al.
6,174,004 B1 * 1/2001 Picard et al. ..... 292/165

* cited by examiner

*Primary Examiner*—Anthony Knight
*Assistant Examiner*—Michael J. Kyle
(74) *Attorney, Agent, or Firm*—Timothy J. Martin; Michael R. Henson; Rebecca A. Gegick

(57) ABSTRACT

A door latch actuator and methodology actuates a mortise-type dead latch that has a spring latch to reciprocally engage and disengage the door latch actuator, and a dead latch pin to operate movement of the spring latch. The actuator's housing has a cavity to receive the spring latch and dead latch pin when the door is fastened, and a reciprocally movable spring latch plunger and dead latch plunger mounted therein. The spring latch plunger's head portion selectively engages the spring latch at different locations when the door is fastened. A striker assembly has arrangeable strike elements defining a strike surface for the dead latch pin and portals for the spring latch for different spring latch and dead latch pin arrangements. The actuator also includes a drive to reciprocally drive the dead latch plunger and advance the spring latch plunger.

27 Claims, 6 Drawing Sheets

AUTOMATED DOOR LATCH ACTUATOR ESPECIALLY ADAPTED FOR MORTISE LOCKS AND METHOD CORRESPONDING THERETO

FIELD OF THE INVENTION

The present invention generally relates to mechanisms which can control access by personnel into and out of buildings or restricted areas. Specifically this invention is to a new and automated door latch actuator that can interface with a more T-type dead latch of a type typically used in commercial applications. This invention can be provided as originally equipment or as a retrofit on existing doors. The invention is also directed to methods of automatically actuating dead latches.

BACKGROUND OF THE INVENTION

This invention is directed to improvements to U.S. Pat. No. 5,474,342 issued Dec. 12, 1995 to Smith et al and to U.S. Pat. No. 6,022,056 issued Feb. 8, 2000 to Cope et al. Each of these patents was directed to operate with North American cylindrical dead latches (also sometimes called tubular or bored dead latches). When used with the North American cylindrical dead latch, the apparatus shown in the '342 Patent and the '056 Patent serve to release the door when electric signal is applied to it.

Where the conventional door latch assembly in the door is of the North American cylindrical dead latch type, the disclosure shown in the '342 Patent has an actuator element disposed in proximity to the distal ends of both the spring latch bolt and the dead latch bolt pin. The driver moves an actuator element between first and second actuator positions. When in the first actuator position, the actuator element is operative to retain the dead bolt latch pin in a disabled (retracted) state while allowing the spring latch bolt to extend into the latch/bolt cavity. The actuator element, when moved from the first actuator position, first releases the dead latch bolt pin which moves into the enabled (extended) state and afterward attacks the distal end of the spring latch bolt to move the spring latch bolt from the extended state to the retracted state.

The '056 Patent was an improvement over the several embodiments of the door latch actuator shown in the '342 Patent. Particularly, the door latch actuator in the '056 Patent employs a spring latch plunger and a dead latch plunger mounted in a housing that has latch cavities sized to receive the spring latch bolt and the dead latch bolt pin. The spring latch plunger engages and retracts under pressure of the spring latch bolt, and the dead latch plunger engages the dead latch bolt pin. A drive operates the plungers to first withdraw the dead latch plunger to allow the dead latch bolt pin to move to an enabling position for the spring latch bolt. Next, the drive advances the spring latch plunger and thereby the spring latch bolt is moved to release position, and the door may be opened. The drive in the '056 Patent is preferably a rotary drive using a motor driven crank and pin system. Sensors are provided to detect the position of the system.

A second type of latch is widely used, especially in commercial application, that significantly differs from the North American cylindrical dead latch. This type of dead latch is common referred to as a "mortise-type" dead latch. The mortise dead latch typically is robust and more costly than a cylindrical dead latch and, as noted, finds it is used almost entirely in commercial and industrial buildings.

Assemblies shown in the '056 Patent employ small plungers that confront one another to operate spring latch and the dead latch which, in the cylindrical dead latch are directly adjacent one another. While the disclosure of the '342 Patent shows several embodiments, including an embodiment using two independently acting solenoids, the technology shown in these patents is difficult to directly apply to mortise-type dead latches. The main difficulty in adapting the technology inherent in the above cited patents derives from the position of the dead latch pin (also called the dead latch trigger) in relation to the spring latch. In the case of mortise-type latches, the dead latch pin is not adjacent to the spring latch but is rather above or below the spring latch depending upon the manufacturer. The wide variety of dead latch pin positions that exist in mortise latches poses a problem for efficient development of an automated door latch actuator. The direct application of the technology in the above described patents would necessitate a different door latch actuator for each different model of mortise dead latch in order to suit the varying positions of the dead latch pin. This increases manufacturing and inventory costs for both manufacturers and distributors.

While the technologies disclosed in the '342 Patent and the '056 Patent present significant advances over prior art automated security latch system, further development is indicated for door latch actuators for mortise-type dead latches. There is a need for door latch actuator constructions and methods which will operate mortise-type dead latch assemblies. There is a further need for a mortise-type dead latch automated actuator which can accommodate different mortise-type dead latch constructions thereby to reduce manufacturing and inventory costs. The present invention is directed to those needs.

SUMMARY OF THE INVENTION

It is an object of the present invention to provide a new and useful method and apparatus for automated actuating of mortise-type dead latch.

Another object of the present invention is to provide a door latch actuator and method that can be implemented with a variety of differently configured mortise-type lock assemblies.

A further object of the present invention is to provide a door latch actuator that is easily installed into existing door frames to interface with mortise-type dead latches.

Still a further object of the present invention is to provide a door latch actuator that is rugged yet simple in construction.

Still a further object of the present invention is to provide a door latch actuator which is relatively inexpensive in manufacture yet reliable in use.

In its broad form, the door latch actuator of the present invention is adapted to mount in a frame portion of a door and engage a mortise-type dead latch disposed on an edge portion of the door. Typically the mortise-type dead latch includes a spring latch and a dead latch pin or trigger that is linearly spaced-apart from the spring latch along the edge portion of the door. This spring latch is reciprocally moveable between an engaged position so that it can engage the door thereby to retain the door in a fastened state and a release position wherein the door is released from the fastened state. The dead latch pin is reciprocally moveable between enabled position that permits movement of the latch spring from the engaged position to the release position and a disabled position that prohibits movement of the spring latch from the engaged position to the release position. The spring latch is resiliently biased into an engaged position and the dead latch is resiliently biased into the enabled position.

The present invention thus includes a housing having a cavity with a forwardly disposed opening that is sized and adapted to receive the spring latch and the dead latch pin when the door is in the fastened state. A spring plunger is mounted for linear reciprocal movement in a longitudinal throw direction in the housing between an extended position and a retracted position. A dead latch plunger is also mounted for linear reciprocal movement in the longitudinal throw direction in the housing between an advanced position and a withdrawn position. A portion of the spring latch is selectively positionable at a selected first location in the opening of the cavity. This first portion of the spring latch plunger is operative to engage the spring latch bolt when the door is in the fastened state thereby to accommodate different locations of the spring latch on the edge portion of the door. A striker assembly is supported on the dead latch plunger and includes an assemble of strike elements operative to define a strike surface for the dead latch pin. The striker assembly provides a portal for the spring latch at a selected portal location. The strike elements are selectively arrangeable into different configurations thereby to vary the selective portal location to accommodate different spring latch and dead latch pin arrangements. A drive is operable to reciprocally drive the dead latch plunger from the advanced position to the withdrawn position and to advance the spring latch plunger from the retracted position to the extended position. With greater detail, the spring latch plunger is configured as a flat first plate oriented in a first plane that extends longitudinally relative to the longitudinal throw direction so as to have a leading edge. The first portion of the spring latched plunger is defined by an attack head disposed on the leading edge of the first plate. This attack head is slideably mounted on the leading edge of the first plate. Here, the leading edge includes a dovetail structure extending therealong, and the attack head has a dovetail channel formed therein that is sized and adapted to matably engage with the dovetail structure for sliding movement along the leading edge of the first plate. A shield may be provided that is adjustably and selectively mounted to the housing and that is operative to support the attack head during reciprocal movement or the spring latch plunger. The attack head is according configured as a rectangular plate oriented transversely to the longitudinal throw direction. The spring latch plunger is biased into the extended position at a force that is less than the typical force exerted by these spring latch.

The dead latch plunger is also configured as a flat plate that is oriented in a plane that extends longitudinally relative to the longitudinal throw direction so as to have a leading edge. The strike elements are then supported on the flat plate and extend laterally thereof. Each of the strike elements is configured as face with an elongated finger projecting therefrom, and each of these fingers extend transversely to the longitudinal throw direction and transversely to the plane of the flat plate. The adjustably and selectively mounted shield is then interposed between the fingers and the head portion. Here, also, the flat plate of the dead latch plunger has a dovetail channel formed therein and the base of each strike element includes a dovetail projection received in the groove for sliding movement therein.

The drive preferably includes a motor operative to rotatably drive a crank with the crank operative to reciprocate both the spring latch plunger and the dead latch plunger. Moreover, the crank operates to first drive the dead latch plunger from the advance position to the withdrawn position and next drive the spring latch plunger from the retracted position to the extended position. The crank can be a rotatable member that is operative to continuously drive the dead latch plunger between the advance and the withdrawn positions during a rotary cycle thereof.

The present invention also concerns a method of actuating a mortise-type latch bolt assembly of the type described above. Broadly, the method includes the first step of placing an attack head within a cavity having an opening in the jam of the door. The attack head is placed at a position to engage the spring latch of a mortise-type latch bolt assembly when the door is in a fastened state with this attack head being in a retracted position. Next, a plurality of independent strike elements are configured within the cavity opening so as to form a strike surface for engaging the dead latch bolt pin when the door is in the fastened state. Here, the strike surface has an advanced position when the dead latch bolt pin is in the disabled position when the door is in the fastened state. Next, the method includes the step of withdrawing the strike surface to a withdrawn position so as to allow the dead latch bolt pin to move into the enable position. Next, the attack head is moved from the retracted position to an extended position thereby to move the spring latch to the release position and disengage the spring latch from the cavity within the door jam. Thereafter, the attack head is retracted to the retracted position.

This general method can also include the step of moving the strike surface from the withdrawn position to the advanced position when the attack head is moved from the retracted position to the extended position. The step of configuring the strike elements can be accomplished wherein the strike surface and the attack head substantially block the opening to the cavity within the door jam. The method of configuring the strike surface can include placing of the strike elements on opposite sides of the attack head. Finally, the method according to the general invention can include the cyclical driving of the attack head in the strike surface after they have been placed in the jam of the door and configured according to the first two steps of the general method.

These and other objects of the present invention will become more readily appreciated and understood from a consideration of the following detailed description of the exemplary embodiment of the present invention when taken together with the accompanying drawings, in which:

DETAILED DESCRIPTION OF THE EXEMPLARY EMBODIMENTS

The present invention is broadly directed to an automated door latch actuator system that is adapted to be installed in a door jam so that it can operate with a mortise-type dead latch assembly such as those found in typical commercial and industrial applications. The present invention also encompasses a method for automated door actuation. The present invention is particularly adapted for use with security doors in industrial and commercial applications wherein the security door can be electronically activated to release the door so that it may be moved from a secured first door position wherein it is secured within the door jam to an open position. The door latch actuator is primarily adapted for use with a mortise-type dead latch assembly mounted in the door. Here, the mortise-type dead latch assembly includes a spring latch and a dead latch pin (also referred to as a dead latch trigger) that are spaced-apart from one another along the edge of the door. Moreover, the present invention is specifically adapted to be mounted in the dimensions of a typical door jam and interface with a variety of different styles of mortise-type dead latches.

Figure 1:
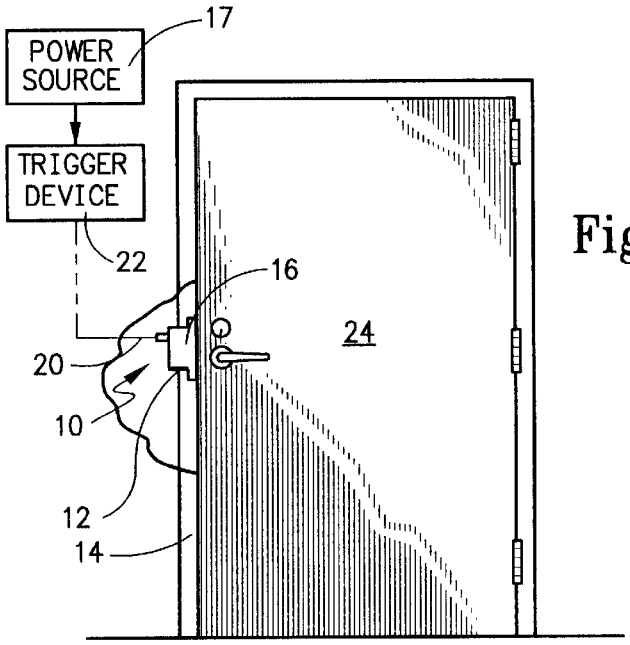
FIG. 1 is a side elevational view of a door in a secure condition at a first door position within a door jam and having a portion of the door jam broken away to show a door latch actuator according to the exemplary embodiment of the present invention and operable with a mortise-type dead latch assembly of the door.
Figure 2:
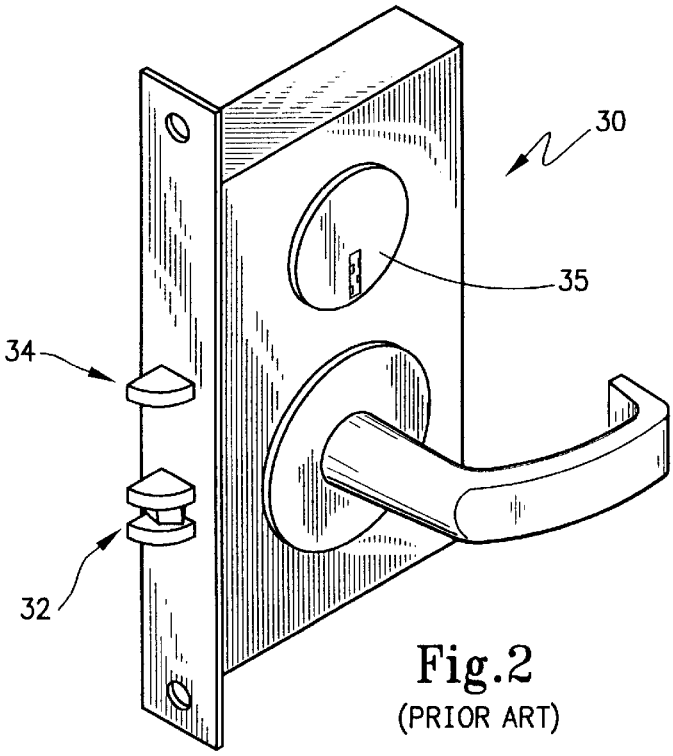
Fig.2 (PRIOR ART)
FIG. 2 is a perspective view of a mortise-type dead latch assembly.

With reference, then to FIG. 1, the exemplary embodiment of the present invention is in the form of an automated door latch actuator 10 that is received in a cavity 12 in a typical door jam 14. Actuator 10 includes an outer housing 16 which mounts its electrical and mechanical components. The electrical components in turn are electrically in communication by means of wiring 20. Actuator 10, for example, may be electrically in communication with a source 17 of electrical power (typically a 12 or 24 volt circuit) and with a trigger device 22. Activation of the trigger device will cause the door latch actuator to activate. The trigger device 22 may typically be a switch whose contacts selectively actuate the door latch actuator. The trigger device 22, however, is often incorporated into a control entry device such as a card reader or digital entry keypad. Here, an authorized card is presented or an authorized code is A typical door 24 is shown in FIG. 1 in a first or closed position. Again, or example purposes, door 24 may be pivotally mounted so that it can move between a closed position and an open position. Door latch actuator 10 is constructed to interface with a mortise-type latch bolt assembly 30 according to the prior art, as is best shown in FIG. 2. In FIG. 2, it may be seen that mortise-type latch bolt assembly 30 includes a spring latch 32 and a dead latch bolt pin 34. Spring latch 32 and dead latch bolt pin 34, when mounted in a door, are linearly spaced-apart from one another along the edge portion of the door. Both spring latch 32 and dead latch bolt pin 34 are spring biased to extend outwardly from latch bolt assembly 30. Thus, as one of ordinarily skill in the art should appreciate, spring latch 32 is slideably moveable between an advanced or "engaged position" such that it can engage the latch bolt receiving cavity and a retracted or "release position" wherein the latch assembly becomes disengaged allowing the door to open.

The dead latch trigger or pin 34 is reciprocally moveable between an advanced or "enabled position" and a retracted or "disable position". As is known to those in the art, when the dead latch bolt pin is in the disabled position, it prevents movement of the spring latch bolt from the engaged position to the release position. However, when the dead latch bolt pin moves into the enabled position, the spring latch bolt may reciprocate between the engaged position and the release position. In FIG. 2, dead latch bolt pin 34 is shown in the enabled position. Spring latch bolt 32 is shown in the engaged position.

Figure 3:
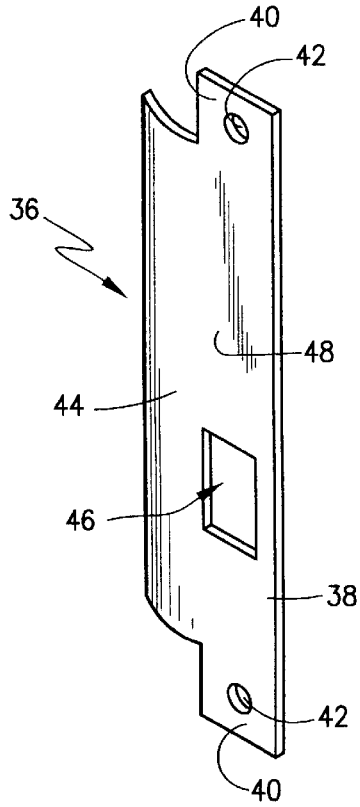
Fig.3 (PRIOR ART)
FIG. 3 is a perspective view of a strike plate according to the prior art for use with a mortise-type dead latch assembly such as that shown in FIG. 2.

With reference now to FIG. 3, it may be seen that a strike plate 36 for use of mortise-type locks of the prior art includes a rectangular central body portion 38 having oppositely projecting mounting tabs 40 provided with holes 42 adapted to receive screws for mounting on door jam 14. A lateral flange 44 projects away from central body 38 in a slightly curved in configuration so as to interact with the curved edges of spring latch 32 and dead latch bolt pin 34 when the door swings shut. A latch bolt receiving cavity in the form of an opening 46 is provided in central body 38 of strike plate 36 so that, when the door closes, spring latch 32 extends therethrough to hold the door in the closed position. Dead latch bolt pin 34, on the other hand, bears against he surface of strike plate 36 in the region designated 48 and is held in the disabled position thereby to lock the door. However, with reference to FIG. 2, mortise-type dead latch assembly 30 typically includes a dead latch lock 35 that includes a cocking mechanism to selectively retain spring latch 32 in the release position or to release spring latch 32 so that it may move between the engaged position and the released position. This construction is believed to be well-known to those skilled in the art and is not part of the present invention.

Figure 4:
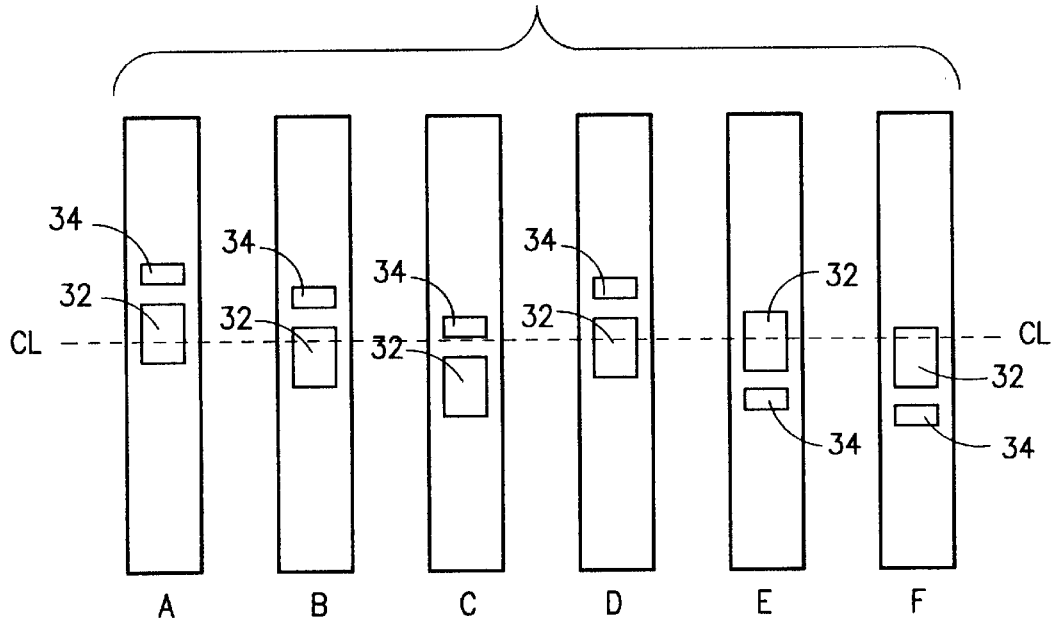
Fig.4 (PRIOR ART)
FIG. 4 is a diagrammatic view showing different configurations of mortise-type dead latch assemblies according to the prior art.

With reference, now, to FIG. 4, a diagrammatic view is provided that shows various spring latch and dead latch bolt pin arrangements with reference to a center line "CL". These relative arrangements of the spring latch 32 and the dead latch bolt pin 34 to each other as well as to the center line correspond to a variety of different manufacturers of mortise-type dead latch assemblies. In FIG. 4, diagrams A–D each show the dead latch bolt pin 34 located above the spring latch 32. In diagram A, spring latch 32 is slightly above center line "CL" while in diagram B, spring latch 32 is slightly below center line "CL". In diagram C, spring latch 32 is completely below center line "CL" while in diagram D, spring latch 32 is at a position near the center line "CL" In diagrams E and F, dead latch bolt pin 34 is located beneath the spring latch 32. In diagram E, spring latch 32 is at a position near center line "CL". In diagram F, spring latch 32 is at a position slightly below the center line "CL".

When addressing the problem of providing an automated door latch actuator from a mortise-type lock assembly, the skilled artisan should now recognize that it would ordinarily be necessary to provide a different actuator for each different mortise-type assembly arrangement. It is highly desirable to provide, however, a single door latch actuator structure which can be customized to each of these spring latch and dead latch bolt pin arrangements as well as other possible arrangement that might be desirable. The present invention is directed to such a universal door latch actuator and method.

Figure 5:
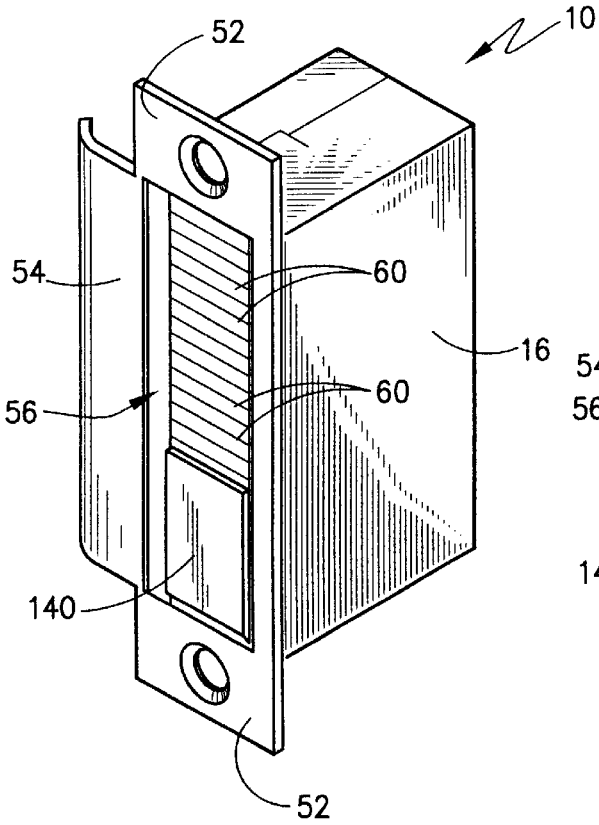
FIG. 5 is a perspective view of a door latch actuator according to the exemplary embodiment of the present invention showing a first representative configuration thereof.
Figure 6:
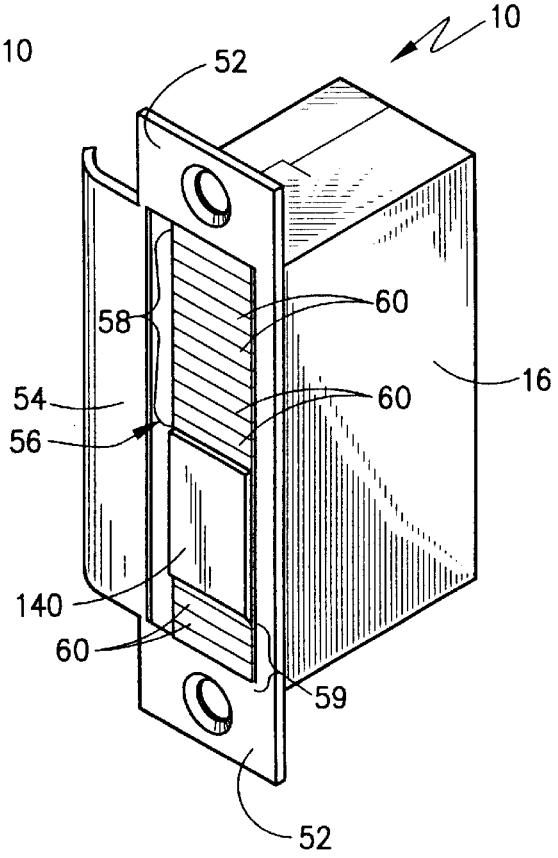
FIG. 6 is a perspective view, similar to FIG. 5, but showing the door latch actuator of the present invention in a second configuration.

According to the present invention, then, a door latch actuator 10 is shown in FIG. 5, and it may be seen that door latch actuator 10 includes an outer housing 16, a pair of mounting tabs 52, a flange 54 all secured to housing 16. However, instead of having the main body of the strike plate, an opening 56 is provided in which is positioned a plurality of strike elements 60 and an attack head 140, the structure of each of these being provided in greater detail below. In FIG. 5, it may be seen that attack head 140 is located at a lowermost location in opening 56 with all of strike elements being located linearly above attack head 140. In FIG. 6, however, it may be appreciated that the door latch actuator 10 has been reconfigured, for example, to operate the mortise-type latch assembly diagrammed as diagram C of FIG. 4. Here, a first set 58 of strike elements 60 are positioned above attack head 140, while a second set of 59 of strike elements 60 are locate below attack head 140. All of strike elements 60 and attack head 140 are located in opening 56 and again form a strike surface for spring latch 32 and dead latch bolt pin 34.

Figure 7:
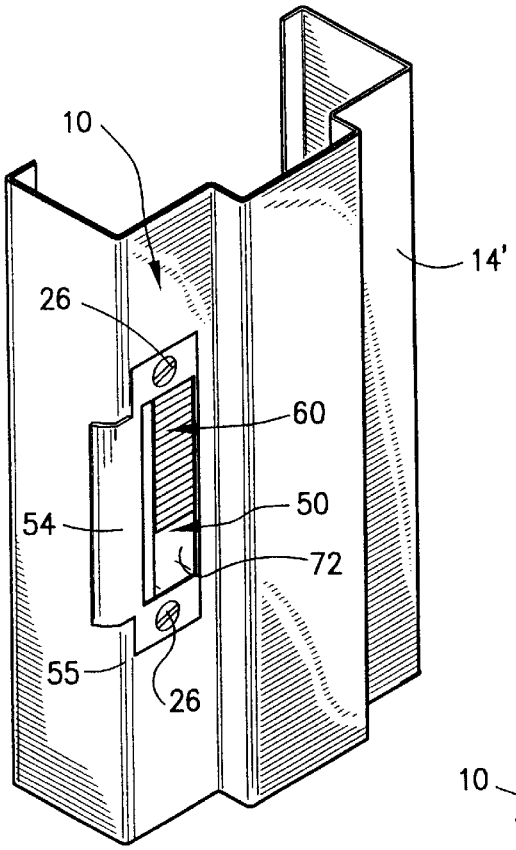
FIG. 7 is a perspective view of the door latch actuator according to the present invention mounted in a portion of the framework forming the door jam.

In FIG. 7, it may be seen that the door latch actuator 10 according to FIG. 5 is mounted by means of screws 26 in door jam 14'. Here it may be seen that flange 54 extends over edge 55 of door jam 14' with strike elements 60 forming a strike surface for the dead latch bolt pin 34. Attack head 140 is moved, however, to a retracted position so as to provide a latch bolt receiving cavity in the form of portal 50 to receive the spring latch so that it may be in an engaged position thereby to retain the door in a fastened state.

Figure 8:
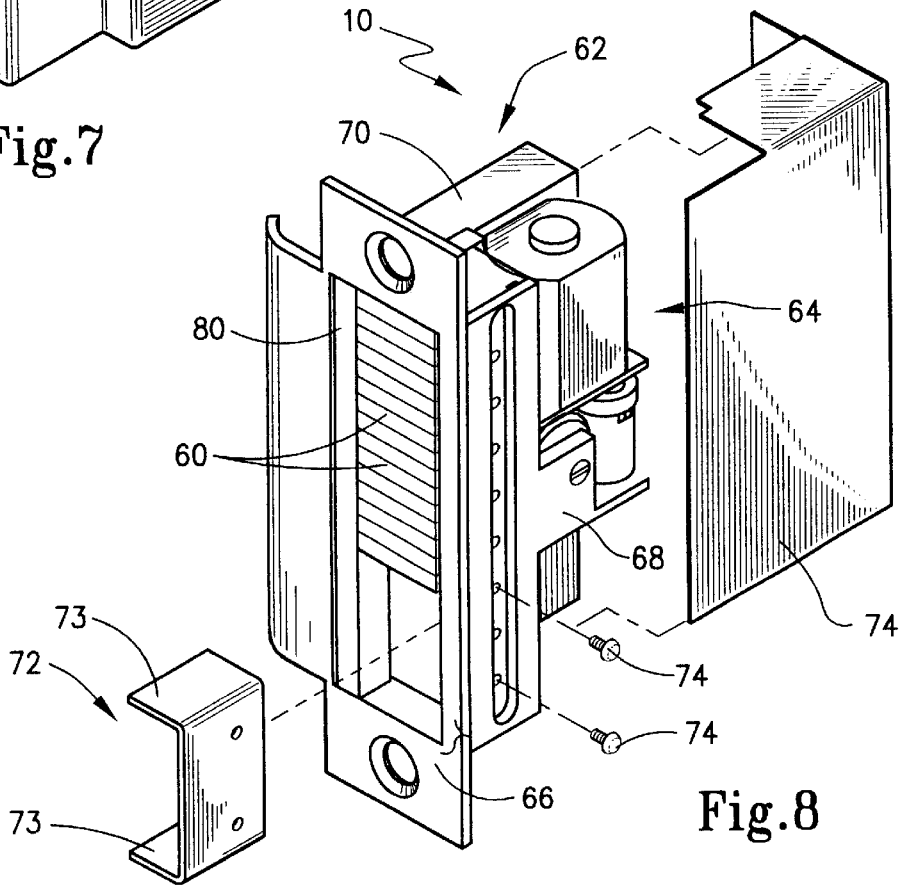
FIG. 8 is a partially exploded perspective view of the door latch actuator shown in FIGS. 5 and 7.

With reference now to FIG. 8, it may be seen that door latch actuator 10 includes a chassis 62 that supports a drive assembly 64, face plate 66, mounting plate 68 and sub-housing 70. A shield 72 is positionable within chassis 62, as more thoroughly described below, and may selectively mounted at various orientations onto mounting plate 68 by means of screws 74. Attack head 140 is supported by a spring latch plunger and is recessed in chassis 62 while strike elements 60 are shown supported on dead latch plunger 80. Both the spring latch plunger and the dead latch plunger 80 are mounted for sliding movement in sub-housing 70, as described in greater detail below. A cover plate 74 mounts over chassis 62 to complete outer housing 16 of door latch actuator 10, as shown in FIGS. 5 and 6.

Figure 11:
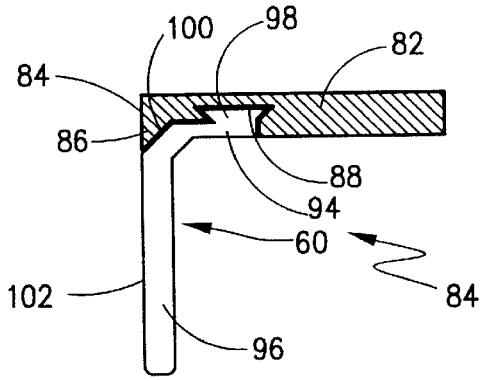
FIG. 11 is a top view, in partial cross-section, showing the strike element of FIG. 10 received in the dead latch plunger plate of FIG. 9.
Figure 9:
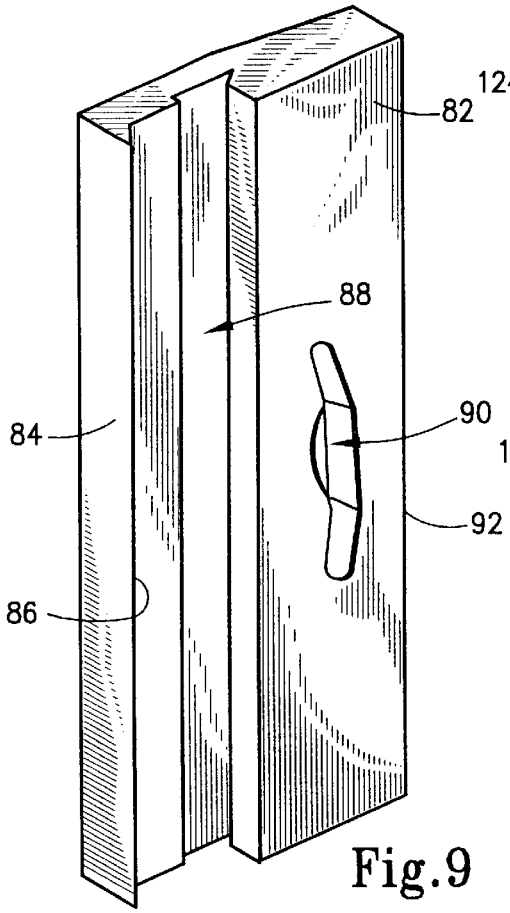
FIG. 9 is a perspective view of the dead latch plunger plate according to the present invention.
Figure 10:
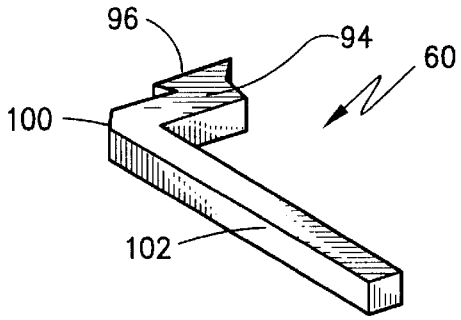
FIG. 10 is a perspective view of a strike element used with the dead latch plunger shown in FIG. 9 according to the present invention.

With reference now to FIGS. 9–11, the structure of dead latch plunger 80 is shown in greater detail. Dead latch plunger 80 includes a flat plate 82 that is generally rectangular in configuration and has a leading edge 84 with an upstanding support lip 86 extending therealong. An elongated dovetail groove 88 extends along the vertical length of plate 82 and is parallel and spaced-apart from leading edge 84. A cam opening 90 is formed medially of plate 82 at a location that is spaced-apart from groove 88 and on a side thereof that is opposite leading edge 84. Thus, cam opening 90 is adjacent trailing edge 92 of plate 82.

Plate 82 is constructed to receive a plurality of strike elements 60, as shown in FIG. 5 and 6, with a representative strike element 60 being depicted in FIG. 10. Strike element 60 is L-shaped in configuration and has a base 94 and an elongated finger 96 extending perpendicularly therefrom. Base 94 also supports a dovetail projection 98 that is sized and adapted to be received in groove 88 for sliding movement therein. A chamfered face 100 is located at the junction of base 94 and finger 96. Lip 86 and chamfered surface 100 are configured so that lip 86 supports strike element 60 at the juncture of base 94 and finger 96. Finger 96 has a forward face 102 that is planar with face 84 when strike element 60 is mounted in groove 88.

Figure 12:
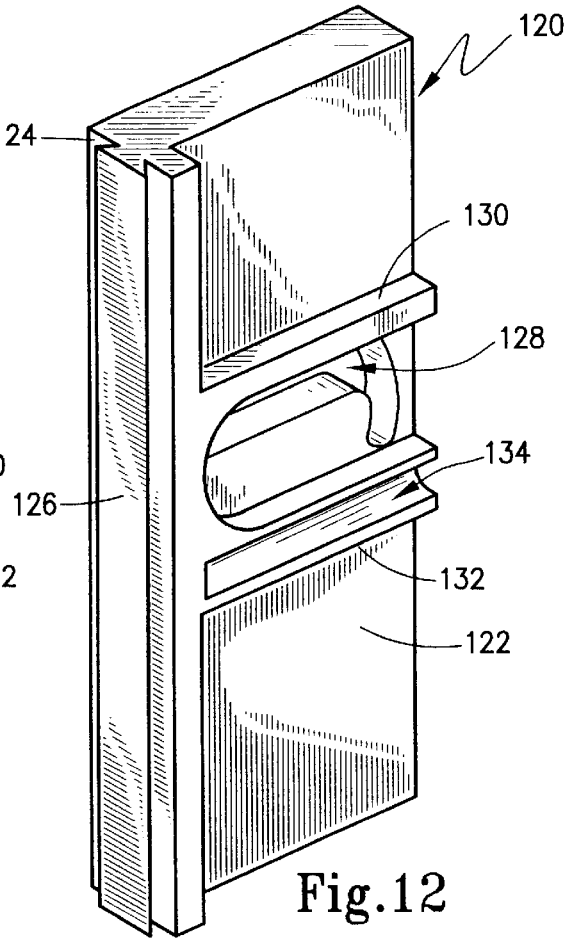
FIG. 12 is a perspective view of the spring latch plunger plate according to the present invention.
Figure 13:
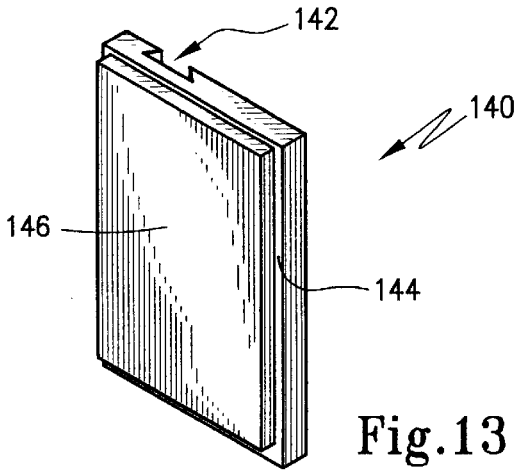
FIG. 13 is a perspective view of the attack head for the spring latch plunger according to the present invention.
Figure 14:
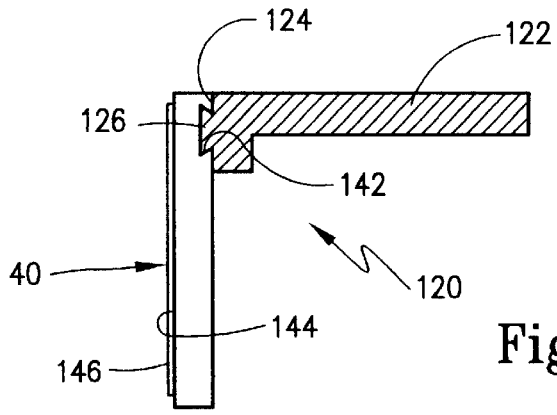
FIG. 14 is a top view in partial cross-section showing the attack head of FIG. 13 mounted on the spring latch plunger plate of FIG. 12.

With reference now to FIGS. 12–14, the structure of the spring latch plunger can now be understood in greater detail. Here, it may be seen that spring latch plunger 120 is configured as a flat plate 122 that has leading edge 124 which includes a dovetail structure 126 extending therealong. A cam opening 128 that is the form of a modified J-shape is formed medially in plate 122. A pair of longitudinally extending reinforcing ribs 130 and 132 extend longitudinally along flat plate 122. Rib 132 is provided with a longitudinally oriented channel 134 that is adapted to receive a resilient biasing element, such as a spring, as described below.

Spring latch plunger 120 includes a portion that is selectively positionable to engage the spring latch bolt of the latch of the mortise-type latch assembly when the doors is in the fastened state. To this end, as is shown in FIG. 13 and 14, an attack head 140 is plate-like and rectangular in shape. Attack head 140 includes a vertically extending groove 142 that is sized and adapted to mate with dovetail structure 126 for sliding movement therealong. A shoulder 144 extends around the peripheral portion of attack head 140 so as to establish an attack face 146 on a forward portion of attack head 140. As is shown in FIG. 14, attack head 140 is slideably positioned on plate 122.

The assembly of door latch actuator 10 can now be more fully understood with reference to FIGS. 8 and 15–17. It may be seen in these Figures that sub-housing 70 of chassis 62 is sized and adapted to slideably receive dead latch plunger 80 and spring latch plunger 120 for linear reciprocal movement therein in a longitudinal throw direction "T". Accordingly, sub-housing 70 has an open interior 71 sized to receive and support both the dead latch plunger and the spring latch plunger. Chassis 62 has an interior 63 which defines a cavity with a forwardly disposed opening which along with interior 71 receives dead latch plunger 80 and spring latch plunger 120. A pair of mounting plates 150 and 152 form a portion of chassis 62 and mount the drive assembly for the dead latch plunger 80 and the spring latch plunger 120.

Figure 15:
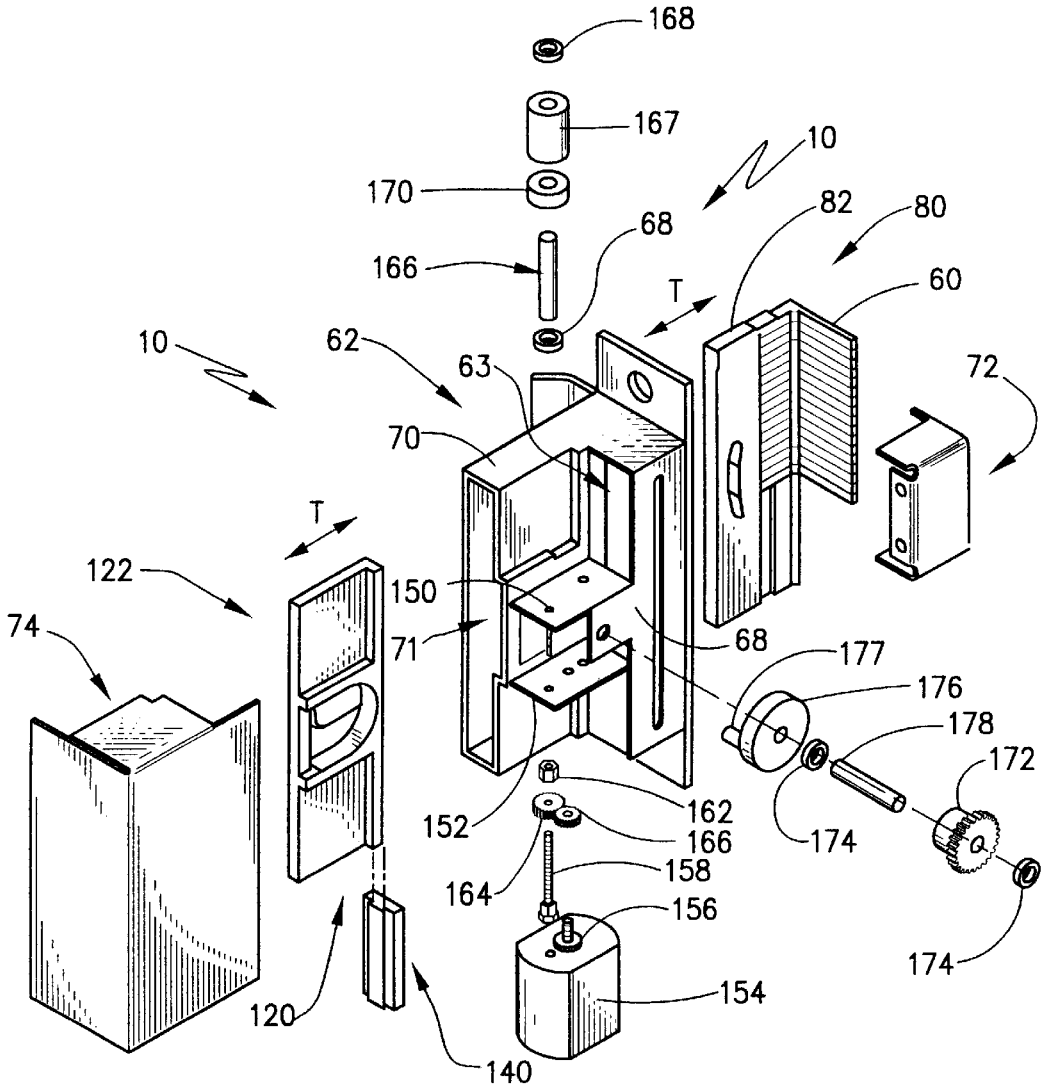
FIG. 15 is an exploded perspective view looking from the lower rear of the door latch actuator according to the present invention.
Figure 16:
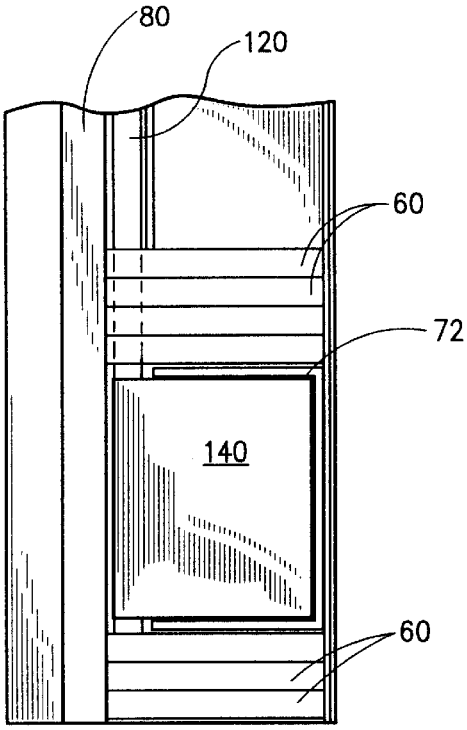
FIG. 16 is a front view, in partial cross-section, showing a second arrangement of the strike elements and attack head along with the mounting of the shield according to the present invention.
Figure 17:
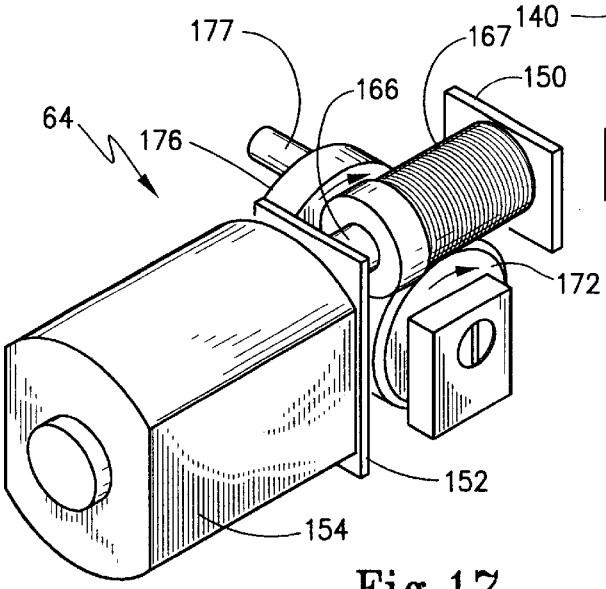
FIG. 17 is a perspective view of the drive motor, gear and crank assembly according to the present invention.

As is shown in FIGS. 15 and 17, a motor 154 has a drive gear 156 and a drive shaft 158 that are mounted on a lower side of plate 152 through pinions 160 and 162, respectively. A spur gear 164 is driven by drive gear 156 so as to turn shaft 158. Shaft 158, in turn, rotates a worm gear formed by worm shaft 166 and worm 167 that are held in position by means of spacers 168. Spur gear 170 engages spur gear 164 of motor 154. The worm gear 167 formed by worm shaft 166 in turn drives worm gear 172 held in position by spacer 174 to turn crank 176 on shaft 178. The assemblies of these various gears between plates 150 and 152 is shown in the assembled state in FIG. 17.

Again with reference to FIG. 15, the operation of door latch actuator 10 may now be more fully understood. After the relative positioning of attack head 140, shield 72 and strike elements 160, described more thoroughly below, the assembled dead latch plunger 80 and spring latch plunger 120 are placed in confronting relationship are placed in confronting relationship within interior 71 of sub-housing 70. Drive pin 177 of crank 176 mates with both cam openings 90 and 128. Thus, as crank 176 is continuously rotated, it will reciprocate dead latch plunger 80 between the advance position and the withdrawn position. Likewise, drive pins 177 will drive spring latch plunger into the extended position and will release spring latch plunger from the extended position so that any force on attack plate 140 (by the spring latch of the mortise latch assembly) will move spring latch plunger 120 back into the retracted position.

With reference again to FIGS. 5, 6, 8, 15 and 16, it will now be appreciated that the position of attack plate 140 and strike elements 60 may be customized for particular application. To accomplish this, one determines how many strike elements 60, if any, should be positioned at the lowermost position in the door latch actuator 10, as is shown in FIG. 6. This number of strike elements are inserted at the lower portion of flat plate 82. Shield 72 is then mounted at the appropriate position on mounting plate 68 by means of screws 74 to define region 50 (see FIG. 7) and the remaining strike elements 60 are then mounted on plate 82 located above shield 72. Shield 72 provides the cavity for attack head 140 which is appropriately positioned on plate 122 and resides within shield 72 between webs 73 thereof. Shield 73 thus guides and positions attack head 140 as well as allowing attack head 140 to be interposed between sets 58 and 59 of strike element 60.

Figure 18:
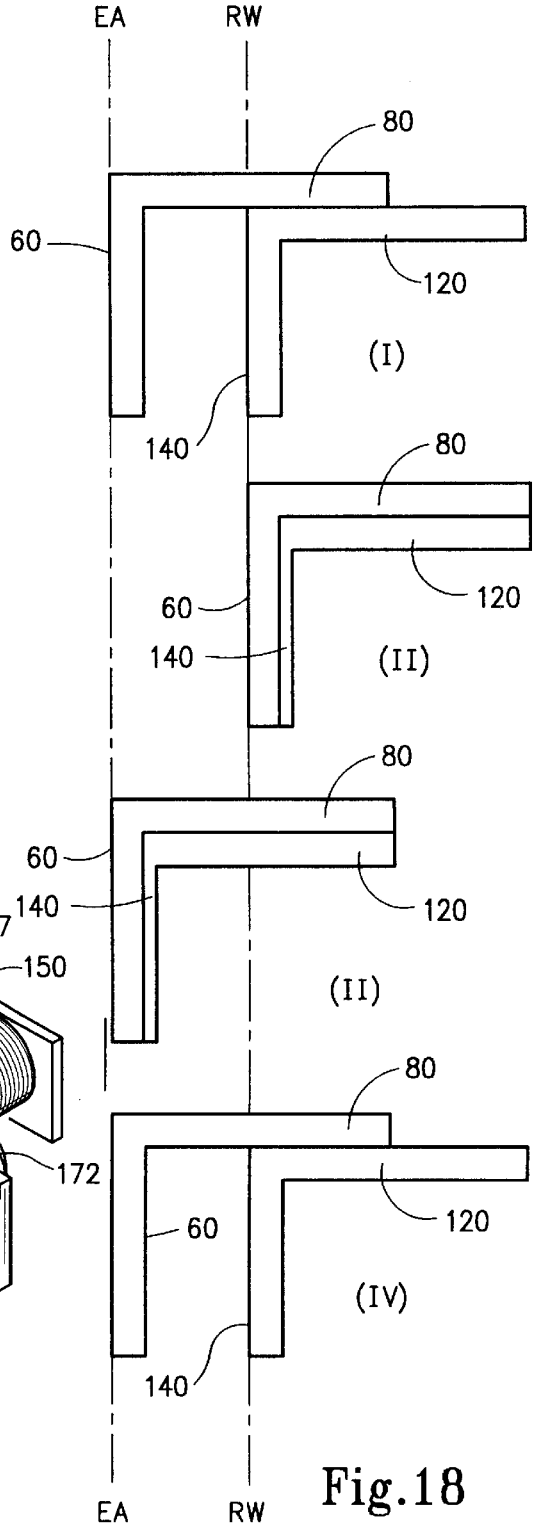
FIG. 18 is a diagrammatic view of a cycle of operation of dead latch plunger and spring latch plunger of the present invention.

With reference now to FIG. 18, a diagram of a cycle of operation of the dead latch plunger 80 and the spring latch plunger 120 can be appreciated with reference to plane "EA" and a plane "RW". Here, plane "EA" represents the edge of the door jam as well as the extended position of the spring latch plunger and the advanced position of the dead latch plunger. Similarly, the plane "RW" corresponds to the retracted position of the spring latch plunger and the withdrawn position of the dead latch plunger. At the start of a cycle, as shown in FIG. 18, diagram (I), spring latch plunger 120 is in the retracted position and dead latch plunger 80 is in the advanced position. In this position, the spring latch of the "mortise-type" latch extends into the door jam in the region between planes "EA" and "RW" immediately in front of attack head 140. Fingers 60 collectively form a strike surface that confronts the dead latch pin and holds dead latch pin in the disabled position to prohibit retraction of the spring latch plunger from the engaged position. As crank 176 begins to turn, upon a signal for automatic door actuation, dead latch plunger 80 is moved to the withdrawn, as is shown in diagram (II) of FIG. 18. When dead latch plunger 80 is withdrawn, the strike surface formed by fingers 60 is displaced into the interior of the door jam thus allowing the dead latch plunger to move from the disabled position to the enable position. At this point, crank 176 continues to rotate and simultaneously moves spring latch plunger 120 from the retracted position to the extended position and moves dead latch plunger 80 from the withdrawn position to the advanced position. As this happens, the spring latch, now enabled, can move to a released position so that the door 24 is disengaged from the latch assembly 30. This is shown in diagram (III) of FIG. 18. Continued rotation of crank 176 allows spring latch plunger 120 to move to the retracted position while dead latch plunger 80 stays in the advanced position, as is shown in (IV) of FIG. 18, and the cycle is completed.

From the foregoing, it should be appreciated that invention provides a method of providing an automatic actuator for a "mortise-type" door latch of various configurations as well as a method for actuating such "mortise-type" latches. The method thus encompasses the steps inherent in the above described mechanical structure. Specifically, the method includes the step of placing an attack head at a retracted position within the jam of a door at a position to engage the spring latch of a "mortise-type" latch on a door mounted within said jam. Here, the jam has a cavity to receive the actuator with an opening for the cavity. Next, a strike surface is configured out of a plurality of strike elements and oriented relative to the attack head and to the dead latch bolt pin so as to provide a strike surface for the dead latch bolt pin when in an advanced position. The method then includes the step of retracting the attack head to a retracted position while holding the strike surface in the advanced position, and thereafter withdrawing the strike surface to the withdrawn position so as to allow the dead latch bolt pin of the "mortise-type" dead latch to move into an enable position. Next, the method comprises the step of moving the attack head from the retracted position to the extended position thereby to disengage the "mortise-type" dead latch from the actuator assembly in the door jam. The method then includes the step of retracting the attack head thereby to create a space to engage the spring latch of the "mortise-type" latch.

The method according to the present invention can also include the step of moving the strike surface from the withdrawn position to the advanced position at the same time the attack head is moved from the retracted position to the extended position. The strike surface and the attack head may be configured so as to substantially block the opening. Here, the step of configuring the strike surface can include the step of placing strike elements on opposite sides of the attack head. The method can also include cyclically repeating the steps of withdrawing the strike surface, moving the attack head from the retracted position to the extended position and thereafter retracting the attack head to the retracted position.

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiment of the present invention without departing from the inventive concepts contained herein.

I claim:

1. A door latch actuator adapted to mount in a frame portion of a door and engage a mortise-type dead latch disposed on and edge portion of the door, said dead latch including a spring latch and a dead latch bolt pin that is linearly spaced-apart from the spring latch along the edge portion of the door, said spring latch being reciprocally movable between an engage position such that it can engage the door latch actuator thereby to retain the door in a fastened state and a release position wherein the door is released from the fastened state, said dead latch bolt pin being reciprocally movable between an enable position that permits movement of the spring latch from the engage position to the release position and a disable position that prohibits movement of the spring latch from the engage position to the release position, said spring latch and said dead latch bolt pin resiliently biased into the engage position and the enable position, respectively, said door latch actuator comprising:

(a) a housing adapted to be mounted in a frame portion of a door and having a cavity with a forwardly disposed opening that is sized and adapted to receive said spring latch and said dead latch pin when the door is in the fastened state;

(b) a spring latch plunger mounted for linear reciprocal movement in a longitudinal throw direction in said housing between an extended position and a retracted position;

(c) a dead latch plunger mounted for linear reciprocal movement in the longitudinal throw direction in said housing between an advanced position and a withdrawn position;

(d) a head portion supported on said spring latch plunger and being selectively positionable at a selected head location in the opening of said cavity, said head portion operative to engage said spring latch bolt when the door is in the fastened state thereby to accommodate different locations of said spring latch on the edge portion of the door;

(e) a striker assembly supported on said dead latch plunger and including an ensemble of strike elements operative to define a strike surface for said dead latch bolt pin and providing a portal for said spring latch at a selected portal location, said strike elements being selectively arrangeable into different configurations thereby to vary the selected portal location to accommodate different spring latch and dead latch pin arrangements; and (f) a drive operative to reciprocally drive said dead latch plunger from the advanced position to the withdrawn position and to advance said spring latch plunger from the retracted position to the extended position.

2. A door latch actuator according to claim 1 wherein said spring latch plunger is configured as a flat first plate oriented in a first plane that extends longitudinally relative to the longitudinal throw direction so as to have a leading edge, said head portion defined by an attack head disposed on the leading edge of said first plate.

3. A door latch actuator according to claim 2 wherein said attack head is slideably mounted on the leading edge of said first plate.

4. A door latch actuator according to claim 3 wherein the leading edge of said first plate includes a dove-tail structure extending therealong, said attack head having a dove-tail channel formed therein that is sized and adapted to matably engage said dove-tail structure for sliding movement along the leading edge of said first plate.

5. A door latch actuator according to claim 4 including a shield adjustably and selectively mounted to said housing and operative to support said attack head during reciprocal movement of said spring latch plunger.

6. A door latch actuator according to claim 2 wherein said attack head is configured as a rectangular plate oriented transversely to the longitudinal throw direction.

7. A door latch actuator according to claim 1 wherein said spring latch plunger is biased into the extended position.

8. A door latch actuator according to claim 1 wherein said dead latch plunger is configured as a flat plate oriented in a plane that extends longitudinally relative to the longitudinal throw direction so as to have a leading edge, said strike elements supported on said flat plate and extending laterally thereof.

9. A door latch actuator according to claim 8 wherein each of said strike elements is configured as a base and an elongated finger projecting therefrom.

10. A door latch actuator according to claim 9 wherein each of said fingers extends transversely to the longitudinal throw direction and transversely to the plane of said flat plate.

11. A door latch actuator according to claim 10 including a shield adjustably and selectively mounted to said housing and interposed between said fingers and said head portion.

12. A door latch actuator according to claim 9 wherein said flat plate has a dove-tail channel formed therein and wherein said base of each said strike element includes a dove-tail projection received in the groove for sliding movement therein.

13. A door latch actuator according to claim 1 wherein said drive includes a motor operative to rotatably drive a crank, said crank operative to reciprocate both of said spring latch plunger and said dead latch plunger.

14. A door latch actuator according to claim 13 wherein said crank operates first to drive said dead latch plunger from the advanced position to the withdrawn position and next to drive said spring latch plunger form the retracted position to the extended position.

15. A door latch actuator according to claim 14 wherein said crank operates to continuously drive said dead latch plunger between the advanced and withdrawn positions during a rotary cycle thereof.

16. A door latch actuator adapted to mount in a frame portion of a door and engage a mortise-type dead latch disposed on and edge portion of the door, said dead latch including a spring latch and a dead latch bolt pin that is linearly spaced-apart from the spring latch along the edge portion of the door, said spring latch being reciprocally movable between an engage position such that it can engage the door latch actuator thereby to retain the door in a fastened state and a release position wherein the door is released from the fastened state, said dead latch pin being reciprocally movable between an enable position that permits movement of the spring latch from the engage position to the release position and a disable position that prohibits movement of the spring latch from the engage position to the release position, said spring latch and said dead latch pin resiliently biased into the engage position and the enable position, respectively, said door latch actuator comprising:

(a) a housing adapted to be mounted in a frame portion of a door and having a cavity with a forwardly disposed opening that is sized and adapted to receive said spring latch and said dead latch pin when the door is in the fastened state;

(b) a spring latch plunger mounted for linear reciprocal movement in a longitudinal throw direction in said housing between an extended position and a retracted position, said spring latch plunger being configured as a flat first plate oriented in a first plane that extends longitudinally relative to the longitudinal throw direction so as to have a leading edge;

(c) a dead latch plunger mounted for linear reciprocal movement in the longitudinal throw direction in said housing between an advanced position and a withdrawn position, said dead latch plunger being configured as a second flat plate oriented in a plane that extends longitudinally relative to the longitudinal throw direction so as to have a leading edge;

(d) an attack head disposed on said first plate and being selectively positionable at a selected head location in the opening of said cavity, said attack head operative to engage said spring latch bolt when the door is in the fastened state thereby to accommodate different locations of said spring latch on the edge portion of the door;

(e) a striker assembly supported on said dead latch plunger and including an ensemble of strike elements operative to define a strike surface for said dead latch pin and providing a portal for said spring latch at a selected portal location, said strike elements supported on said second flat plate and extending laterally thereof and being selectively arrangeable into different configurations thereby to vary the selected portal location to accommodate different spring latch and dead latch bolt pin arrangements; and (f) a drive operative to reciprocally drive said dead latch plunger from the advanced position to the withdrawn position and to advance said spring latch plunger from the retracted position to the extended position.

17. A door latch actuator according to claim 16 wherein said attack head is slideably mounted on the leading edge of said first plate.

18. A door latch actuator according to claim 17 wherein the leading edge of said first plate includes a dove-tail structure extending therealong, said attack head having a dove-tail channel formed therein that is sized and adapted to matably engage said dove-tail structure for sliding movement along the leading edge of said first plate.

19. A door latch actuator according to claim 18 including a shield adjustably and selectively mounted to said housing and operative to support said attack head during reciprocal movement of said spring latch plunger.

20. A door latch actuator according to claim 17 wherein said attack head is configured as a rectangular plate oriented transversely to the longitudinal throw direction.

21. A door latch actuator according to claim 16 wherein each of said strike elements is configured as a base and an elongated finger projecting therefrom.

22. A door latch actuator according to claim 21 wherein each of said fingers extends transversely to the longitudinal throw direction and transversely to the plane of said second plate.

23. A method of actuating a mortise-type latch bolt assembly disposed on an edge portion of the door by a mechanism mounted within a jam supporting said door wherein said dead latch includes a spring latch and a dead latch bolt pin that is linearly spaced apart from the spring latch along the edge portion of the door, said spring latch being reciprocally movable between an engage position such that it can engage the door latch actuator thereby to retain the door in a fastened state and a release position wherein the door is released from the fastened state, said dead latch bolt pin being reciprocally movable between an enable position that permits movement of the spring latch from the engage position to the release position, said spring latch and said dead latch bolt pin resiliently biased into the engage position and the enable position, respectively, and wherein the jam has a cavity having an opening that is larger in dimension than said spring latch and said dead latch bolt pin, the method comprising the steps of:

(a) placing an attack head within the jam of the door at a position to engage the spring latch, said attack head having a retracted position wherein the spring latch is in the engage position when the door is in the fastened state;

(b) configuring a plurality of independent strike elements that are selectively configured within the jam of the door so as to form a strike surface that may be varied to accommodate different spring latch and dead latch pin arrangements and is of a selected configuration adapted to engage the dead latch bolt pin when the door is in the fastened state wherein the strike surface has an advanced position wherein the dead latch bolt pin is in the disable position;

(c) withdrawing the strike surface to a withdrawn position so as to allow the dead latch bolt pin to move into the enable position;

(d) moving the attack head from the retracted position to an extended position thereby to move the spring latch to the release position to disengage the spring latch from the cavity; and (e) thereafter retracting the attack head to the retracted position.

24. The method according to claim 23 including the step of moving the strike surface from the withdrawn position to the advanced position when the attack head is moved from the retracted position to the extended position.

25. The method according to claim 23 wherein the strike surface and the attack head substantially block the opening.

26. The method according to claim 25 wherein the step of configuring the strike surface includes placing strike elements on opposite sides of said attack head.

27. The method according to claim 23 including cyclically repeating steps (c), (d) and (e).

* * * * *

UNITED STATES PATENT AND TRADEMARK OFFICE

CERTIFICATE OF CORRECTION

PATENT NO. : 6,581,991 B1
DATED : June 24, 2003
INVENTOR(S) : Jaime Galindo

It is certified that error appears in the above-identified patent and that said Letters Patent is hereby corrected as shown below:

Drawings,
Sheet 5, Figure 15, the reference numeral "68" should read -- 168 --;
Sheet 5, Figure 15, reference numeral "160" should point to the pinion.
Sheet 6, Figure 18, the reference numeral (II) should read -- (III) --.

Column 1,
Line 5, "a more T-type", should read -- a mortise-type --.

Column 3,
Line 19, "assemble" should read -- assembly --.
Line 44, "according" should read -- accordingly --;
Line 45, "these" should read -- the --.

Column 6,
Line 8, "or" should read -- for --;
Line 20, "skill" should read -- skilled --.

Column 9,
Line 9, "160" should read -- 60 --.

Signed and Sealed this

Twenty-eighth Day of October, 2003

JAMES E. ROGAN
*Director of the United States Patent and Trademark Office*